US010163388B2

(12) United States Patent
Zhang et al.

(10) Patent No.: US 10,163,388 B2
(45) Date of Patent: Dec. 25, 2018

(54) LIGHT-EMITTING DIODE DISPLAYS WITH PREDICTIVE LUMINANCE COMPENSATION

(71) Applicant: Apple Inc., Cupertino, CA (US)

(72) Inventors: Yifan Zhang, San Mateo, CA (US); Paul S. Drzaic, Morgan Hill, CA (US); Chieh-Wei Chen, Cupertino, CA (US); Jean-Pierre S. Guillou, San Francisco, CA (US); Koorosh Aflatooni, Los Altos Hills, CA (US)

(73) Assignee: Apple Inc., Cupertino, CA (US)

( * ) Notice: Subject to any disclaimer, the term of this patent is extended or adjusted under 35 U.S.C. 154(b) by 17 days.

(21) Appl. No.: 14/936,343

(22) Filed: Nov. 9, 2015

(65) Prior Publication Data

US 2017/0076659 A1 Mar. 16, 2017

Related U.S. Application Data

(60) Provisional application No. 62/218,445, filed on Sep. 14, 2015.

(51) Int. Cl.
*G09G 3/3208* (2016.01)
*G09G 3/20* (2006.01)

(52) U.S. Cl.
CPC ..... *G09G 3/3208* (2013.01); *G09G 3/2003* (2013.01); *G09G 2320/043* (2013.01); *G09G 2320/0666* (2013.01)

(58) Field of Classification Search
CPC ..... G09G 3/30–3/3258
See application file for complete search history.

(56) References Cited

U.S. PATENT DOCUMENTS 6,094,639 A * 7/2000 Kubota ..... G06Q 30/02 705/1.1
9,368,683 B1 * 6/2016 Meitl ..... H01L 33/20
9,401,020 B1 * 7/2016 Li ..... G06K 9/481
2005/0110420 A1 5/2005 Arnold et al.
2005/0280766 A1 * 12/2005 Johnson ..... G09G 3/3216 349/167
2006/0012708 A1 * 1/2006 Rosmalen ..... G09G 3/3208 348/503

(Continued)

*Primary Examiner* — Patrick N Edouard
*Assistant Examiner* — Peijie Shen
(74) *Attorney, Agent, or Firm* — Treyz Law Group, P.C.; G. Victor Treyz; David K. Cole

(57) ABSTRACT

An electronic device may be provided with a display. A content generator may generate frames of image data to be displayed on the display. The display may have an array of pixels that emit light to display images. The pixels may contain light-emitting devices such as organic light-emitting diodes, quantum dot light-emitting diodes, and light-emitting diodes formed from discrete semiconductor dies. As a result of aging, the light producing capabilities of the light-emitting devices may degrade over time. The electronic device may have a temperature sensor that gathers temperature measurements. A pixel luminance degradation compensator may apply compensation factors to uncorrected pixel luminance values associated with the frames of image data to produce corresponding corrected pixel luminance values for the display. The compensation factors may be based on aging history information such as pixel luminance history and temperature measurements.

9 Claims, 6 Drawing Sheets

(56) References Cited

U.S. PATENT DOCUMENTS

2006/0077136 A1* 4/2006 Cok ..... G09G 3/3216 345/76
2006/0187182 A1* 8/2006 Yu ..... G09G 5/10 345/102
2006/0227085 A1* 10/2006 Boldt, Jr. ..... G09G 3/32 345/83
2007/0063932 A1 3/2007 Nathan et al.
2007/0079381 A1* 4/2007 Hartung ..... G06F 21/10 726/26
2007/0290957 A1* 12/2007 Cok ..... G09G 3/3225 345/77
2008/0055339 A1* 3/2008 Chao ..... G09G 3/2003 345/690
2008/0062112 A1* 3/2008 Umezaki ..... G09G 3/342 345/100
2008/0174515 A1* 7/2008 Matthies ..... G02F 1/13336 345/1.3
2010/0123694 A1* 5/2010 Cok ..... G09G 3/20 345/206
2011/0095291 A1* 4/2011 Quitoriano ..... C30B 25/02 257/52
2011/0181572 A1* 7/2011 Chen ..... G09G 3/3233 345/211
2012/0151258 A1* 6/2012 Lee ..... G06F 11/1417 714/15
2014/0015824 A1* 1/2014 Chaji ..... G09G 3/32 345/212
2014/0055500 A1* 2/2014 Lai ..... G09G 3/3208 345/690
2014/0292342 A1* 10/2014 Chaji ..... G09G 3/006 324/414
2014/0306868 A1* 10/2014 Chaji ..... G09G 3/006 345/77
2014/0368416 A1* 12/2014 Gu ..... G09G 3/3233 345/78
2015/0026485 A1* 1/2015 Mostovych ..... G06F 21/86 713/194
2015/0103106 A1* 4/2015 Chaji ..... G09G 3/3291 345/690
2016/0099262 A1* 4/2016 Lin ..... H01L 27/3255 257/43
2016/0126293 A1* 5/2016 Li ..... H01L 33/06 257/29
2016/0358539 A1* 12/2016 Zhang ..... H01L 27/32
2017/0278733 A1* 9/2017 Chang ..... H01L 21/67144

* cited by examiner

LIGHT-EMITTING DIODE DISPLAYS WITH PREDICTIVE LUMINANCE COMPENSATION

This application claims the benefit of provisional patent application No. 62/218,445 filed on Sep. 14, 2015, which is hereby incorporated by reference herein in its entirety.

BACKGROUND

This relates generally to electronic devices with displays, and, more particularly, to displays with pixels that are subject to aging effects.

Electronic devices often include displays. Displays such as light-emitting diode displays have individually controlled pixels. These pixels emit light to display images for a user. Light-emitting structures in the pixels of a display may be subject to aging effects. As a result, pixel luminance can drop over time. The luminance of pixels that are lightly used may be relatively stable as a function of time, whereas the luminance of pixels that are heavily used may degrade as a function of time. In color displays, pixels of different colors may age differently, leading to potential color shifts over time. These affects may affect display performance.

It would therefore be desirable to be able to provide ways to overcome undesired pixel aging effects in devices with displays.

SUMMARY

An electronic device may be provided with a display. A content generator may generate frames of image data to be displayed on the display.

The display may have an array of pixels. The pixels may emit light to display images for a user. The pixels may contain light-emitting devices such as organic light-emitting diodes, quantum dot light-emitting diodes, and light-emitting diodes formed from discrete semiconductor dies.

As a result of aging, the light producing capabilities of the light-emitting devices in the display may degrade over time. To ensure that images that are appropriately displayed on the display, aging history information may be stored in the device for each of the pixels in the display. The aging history information may take into account the luminance history of each pixel and, if desired, operating temperature information.

A pixel luminance degradation compensator may compute compensation factors based on the aging history. The pixel luminance degradation compensator may apply the compensation factors to uncorrected pixel luminance values associated with the frames of image data to produce corresponding corrected pixel luminance values for the display.

Further features will be more apparent from the accompanying drawings and the following detailed description.

DETAILED DESCRIPTION

Figure 1:
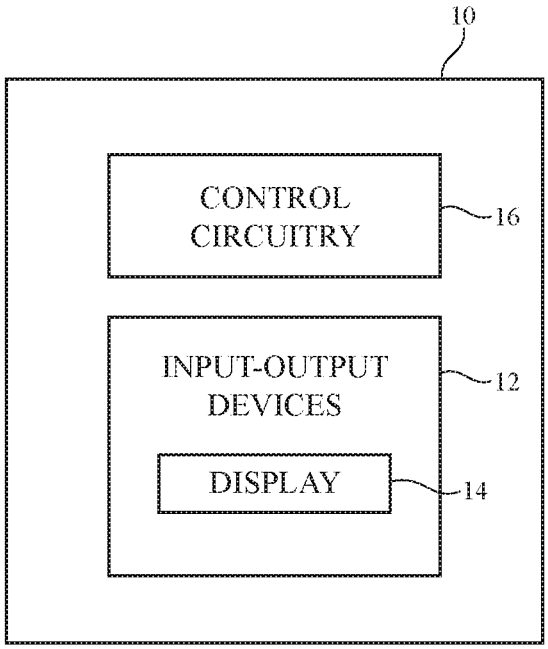
FIG. 1 is a schematic diagram of an illustrative electronic device having a display in accordance with an embodiment.

An illustrative electronic device of the type that may be provided with a display is shown in FIG. 1. As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

Control circuitry 16 may be used to run software on device 10 such as operating system code and applications. During operation of device 10, the software running on control circuitry 16 may display images on display 14 using an array of pixels in display 14.

Device 10 may be a tablet computer, laptop computer, a desktop computer, a display, a cellular telephone, a media player, a wristwatch device or other wearable electronic equipment, or other suitable electronic device.

Display 14 may contain pixels based on light-emitting devices. The light-emitting devices may be light-emitting diodes (e.g., organic light-emitting didoes, micro-light-emitting diodes formed from discrete crystalline semiconductor dies, quantum dot light-emitting diodes, etc.) or other light-emitting components. Display 14 may be a monochrome display or a color display. In a color display, the pixels may include red, green, and blue pixels or other sets of pixels of different colors (e.g., cyan pixels, white pixels, yellow pixels, etc.).

Display 14 may have a rectangular shape (i.e., display 14 may have a rectangular footprint and a rectangular peripheral edge that runs around the rectangular footprint) or may have other suitable shapes. Display 14 may be planar or may have a curved profile.

Figure 2:
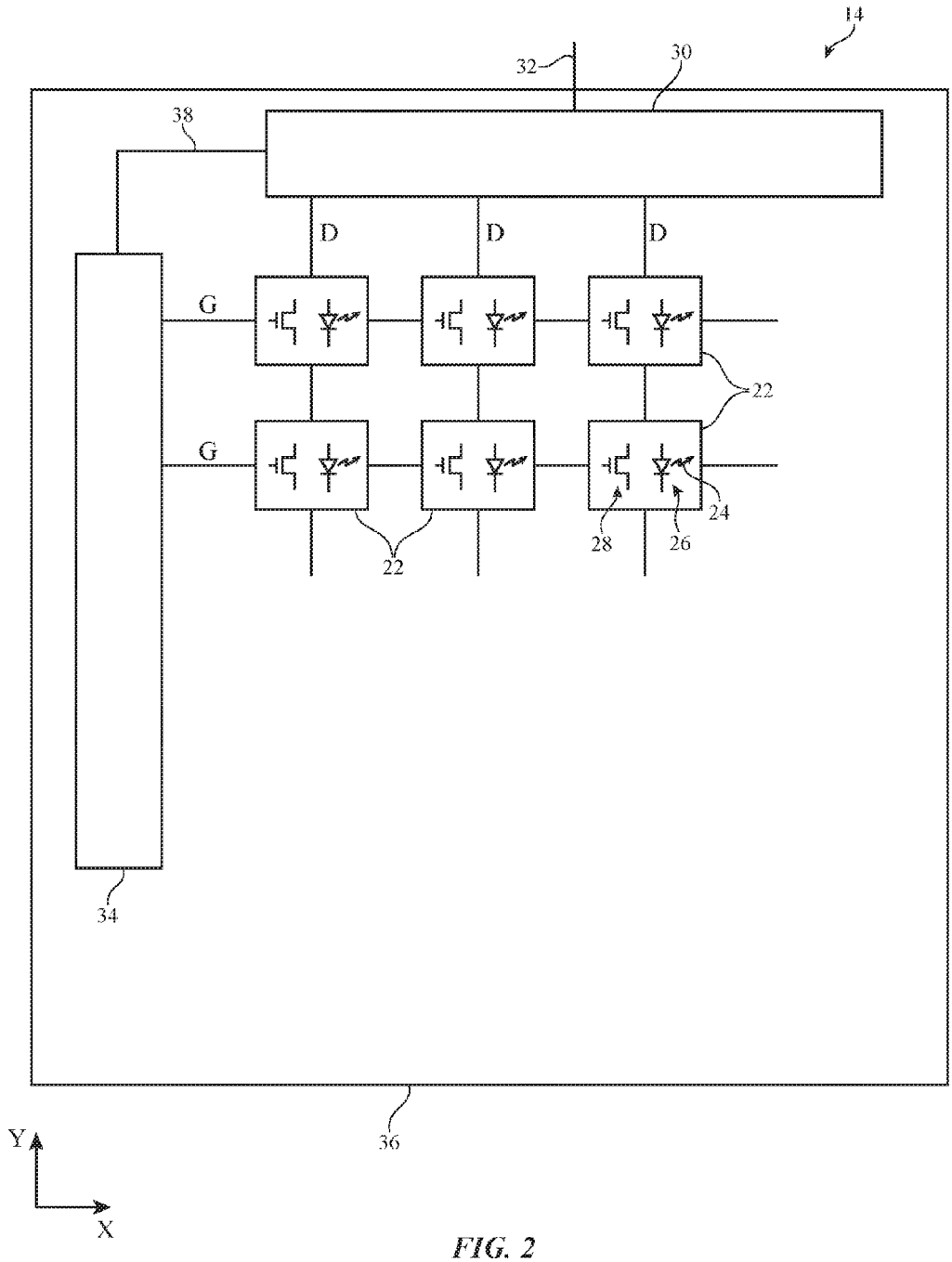
FIG. 2 is a top view of an illustrative display in an electronic device in accordance with an embodiment.

A top view of a portion of display 14 is shown in FIG. 2. As shown in FIG. 2, display 14 may have an array of pixels 22 formed on substrate 36. Substrate 36 may be formed from glass, metal, plastic, ceramic, or other substrate materials. Pixels 22 may receive data signals over signal paths such as data lines D and may receive one or more control signals over control signal paths such as horizontal control lines G (sometimes referred to as gate lines, scan lines, emission control lines, etc.). There may be any suitable number of rows and columns of pixels 22 in display 14 (e.g., tens or more, hundreds or more, or thousands or more). Pixels 22 may extend horizontally in rows along lateral dimension x and vertically in columns along lateral dimension y.

Each pixel 22 may have a light-emitting component such as one of light-emitting diodes 26 that emits light 24 under the control of a pixel control circuit. Pixel control circuits may be formed from components such as transistors. With one illustrative configuration, pixel control circuitry may be formed from thin-film transistor circuitry such as thin-film transistors 28 and thin-film capacitors. Transistors 28 may be silicon transistors, polysilicon thin-film transistors, semiconducting-oxide thin-film transistors such as indium zinc gallium oxide transistors, or thin-film transistors formed from other semiconductors. Pixels 22 may contain light-emitting diodes 26 of different colors (e.g., red, green, and blue or other colors) to provide display 14 with the ability to display color images.

Display driver circuitry may be used to control the operation of pixels 22. The display driver circuitry may be formed from integrated circuits, thin-film transistor circuits, or other suitable circuitry. Display driver circuitry 30 of FIG. 2 may contain communications circuitry for communicating with system control circuitry such as control circuitry 16 of FIG. 1 over path 32. Path 32 may be formed from traces on a flexible printed circuit or other cable. During operation, the control circuitry (e.g., control circuitry 16 of FIG. 1) may supply circuitry 30 with information on images to be displayed on display 14.

To display the images on display pixels 22, display driver circuitry 30 may supply image data to data lines D while issuing clock signals and other control signals to supporting display driver circuitry such as gate driver circuitry 34 over path 38. If desired, circuitry 30 may also supply clock signals and other control signals to gate driver circuitry on an opposing edge of display 14.

Gate driver circuitry 34 (sometimes referred to as horizontal control line control circuitry) may be implemented as part of an integrated circuit and/or may be implemented using thin-film transistor circuitry. Horizontal control lines G in display 14 may carry gate line signals (scan line signals), emission enable control signals, and other horizontal control signals for controlling the pixels of each row. There may be any suitable number of horizontal control signals per row of pixels 22 (e.g., one or more, two or more, three or more, four or more, etc.).

In organic light-emitting diode displays, colored emissive material may be used to provide the light-emitting diodes with the ability to emit red, green, and blue light (or light of other colors). For example, red organic light-emitting diodes may contain red organic emissive material, green organic light-emitting diodes may contain green organic emissive material, and blue organic light-emitting diodes may contain blue organic emissive material. The emissive material may degrade as the light-emitting diodes are used. Heavy use, in which diodes are driven with large currents, may age the diodes more rapidly than light use, in which the diodes are driven with small currents. As the diodes age, the degraded emissive material will cause the diodes to emit a reduced amount of light for a given drive current. Pixel luminance in organic light-emitting diode displays is therefore generally a function of the aging history of the pixels in the display. Because emissive material of different colors tends to age differently, color shifts may arise as a organic light-emitting diode display ages. Color shifts may also arise due to aging effects in displays such as micro-light-emitting diode displays (i.e., displays with arrays of discrete light-emitting diode dies) and quantum dot displays.

To compensate for these undesired aging-induced color shifts and therefore ensure that display 14 can display images accurately, device 10 may be provided with pixel luminance degradation compensation capabilities. In particular, the control circuitry of device 10 may be used to implement a pixel luminance degradation compensator that maintains information on the aging history of each of the pixels in display 14. Based on this aging information, the pixel luminance degradation compensator can adjust the luminance values supplied to each of the pixels in display 14. During operation, the pixels that have degraded due to aging may be supplied with pixel luminance values that have been increased to offset the expected reduced light output of these pixels. This ensures that the color of images displayed on display 14 will remain stable and accurate as a function of time, even if the luminance of some of the pixels in the display has decreased due to aging effects.

Figure 3:
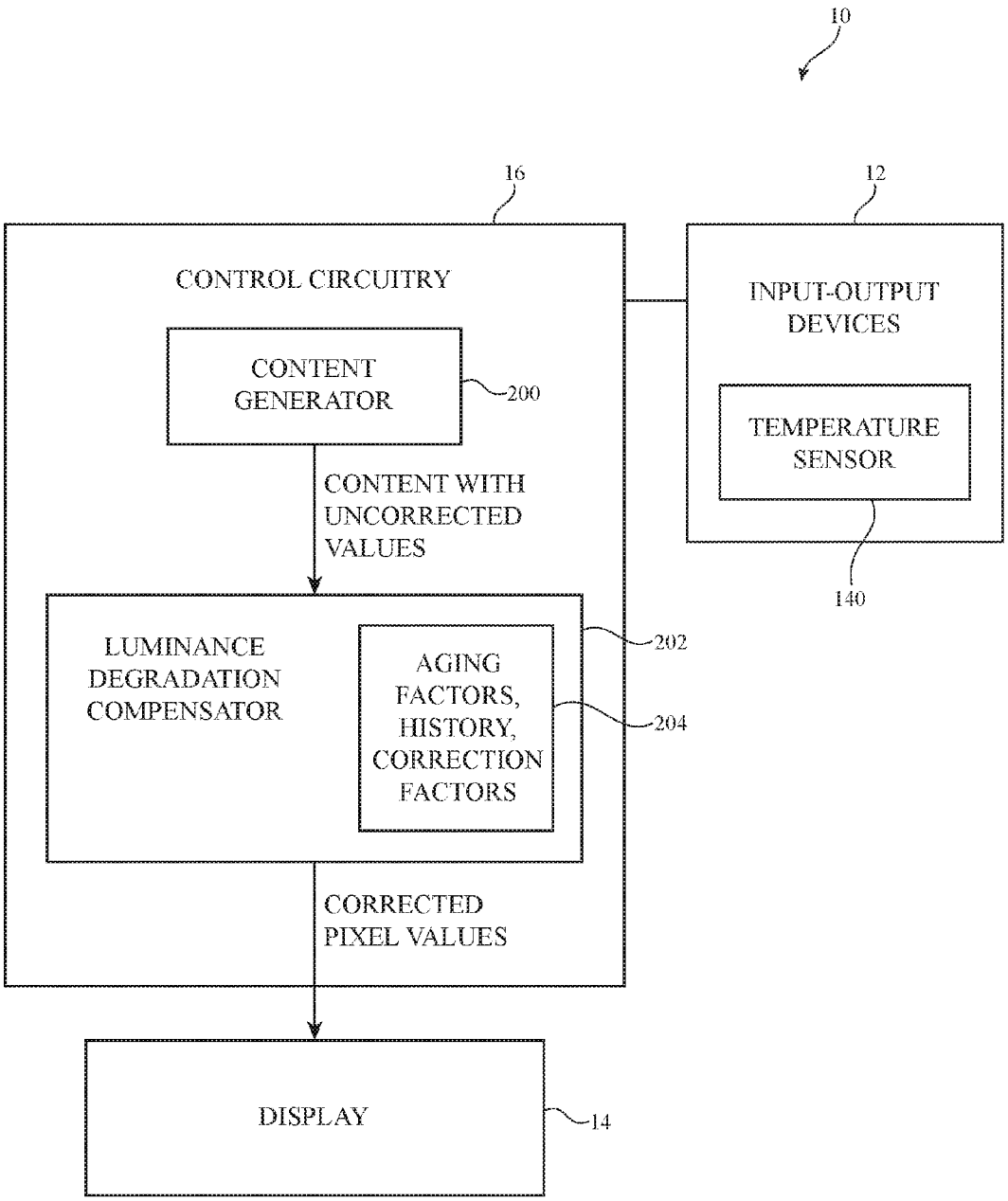
FIG. 3 is a schematic diagram of an illustrative electronic device with a display in accordance with an embodiment.

Illustrative circuitry of the type that may be used by device 10 to control display 14 while monitoring aging effects is shown in FIG. 3. As shown in FIG. 3, device 10 may have control circuitry 16. Content generator 200 may be an application running on control circuitry 16 such as a game, a media playback application, an application that presents text to a user, an operating system function, or other code running on control circuitry 16 that generates image data to be displayed on display 14. The image data may include pixel values (sometime referred to as pixel luminance values) for each of the pixels in display 14. Image data may be generated in image frames.

Pixel luminance degradation compensator 202 may be implemented on control circuitry 16. Control circuitry 16 may include storage for maintaining information 204 that is used by compensator 202. For example, control circuitry 16 may have storage for maintaining information 204 that compensator 202 uses to adjust the luminance values for content from content generator 200 before that content is supplied to display 14. Information 204 may include information on how pixel luminance varies as a function of use (sometime referred to as aging factor information), information on the usage history of each pixel or set of pixels (e.g., historical aging information based on the luminance values supplied to the pixels over the lifetime of display 14 and, if desired, operating temperature information), information on corresponding correction factors that can be applied to the pixels to compensate for aging-induced luminance degradation, and other information for supporting the operation of pixel luminance degradation compensator 200). To ensure that compensator 202 can accurately compensate display 114 for aging effects even in the event that other device settings are reset, it may be desirable to maintain information 204 in protected storage (e.g., a protected memory space that will not be overwritten when reinstalling the operating system for device 10, when updating the operating system or other settings for device 10, when resetting device 10 to default factory settings, or when otherwise installing operating system code, updates, etc.).

Control circuitry 16 may be coupled to input-output circuitry such as input-output devices 12. Input-output devices 12 may include a temperature sensor such as temperature sensor 140 to gather information on the current operating temperature of display 14. If desired, this temperature information can be used in maintaining the aging history for the pixels in display 14. At high operating temperatures, aging effects are accelerated, so by monitoring the operating temperature of the pixels in display 14, color shifts associated with operation of display 14 at elevated temperatures can be compensated.

During manufacturing, display 14 (or a representative display of the same design) may be tested to determine the aging characteristics of the pixels in display 14. For example, accelerated aging tests may be performed to determine how much the pixels of each color age as a function of time, luminance, and optionally operating temperature. A look-up table or set of equations may be stored in device 10 that represents the measured aging characteristics of the pixels in display 14. Examples of functions that may be used to represent the luminance aging behavior of the pixels in display 14 include polynomial functions, exponential functions, logarithmic functions, trigonometric functions, series, etc.

Once the aging behavior of the pixels of display 14 has been stored in device 10, device 10 can be used to display images for a user. As each pixel is illuminated and used in displaying content for a user, the luminance of that pixel and the duration for which the pixel is driven at that luminance level may be used, in conjunction with the known aging behavior of the pixels, to determine that amount of aging experienced by that pixel (i.e., an aging history value). The aging history information for the pixels may be maintained in storage (e.g., as part of a matrix containing pixel aging history entries for all pixels in display 14 or other data structure). Temperature information may be taken into account when determining the aging history values for the pixels, if desired.

The matrix of aging history entries that is maintained may have the same number of entries as there are pixels in display 14 (i.e., a separate aging history may be maintained for each pixel in display 14) or averaged aging history information may be maintained for clusters of adjacent pixels (e.g., 2×2 blocks of pixels, 1×3 blocks of pixels, or other sets of pixels) to reduce storage requirements. Aging history entries may be maintained using any suitable level of accuracy (e.g., the digital words that are used to maintain the aging history information may have the same number of bits as the pixel luminance values used in displaying information on display 14, may have a larger number of bits, or may have a smaller number of bits (e.g., to reduce storage requirements).

The aging behavior of pixels of different colors will generally be different. Pixel aging effects will also generally be non-linear as a function of pixel luminance (and temperature, if monitored). As part of the process of determining the aging history for each pixel, it may therefore be desirable to compute aging factors based on luminance level and temperature level that can be used to help translate pixel luminance values (and operating temperatures) into expected amounts of pixel luminance degradation (aging).

Figure 4:
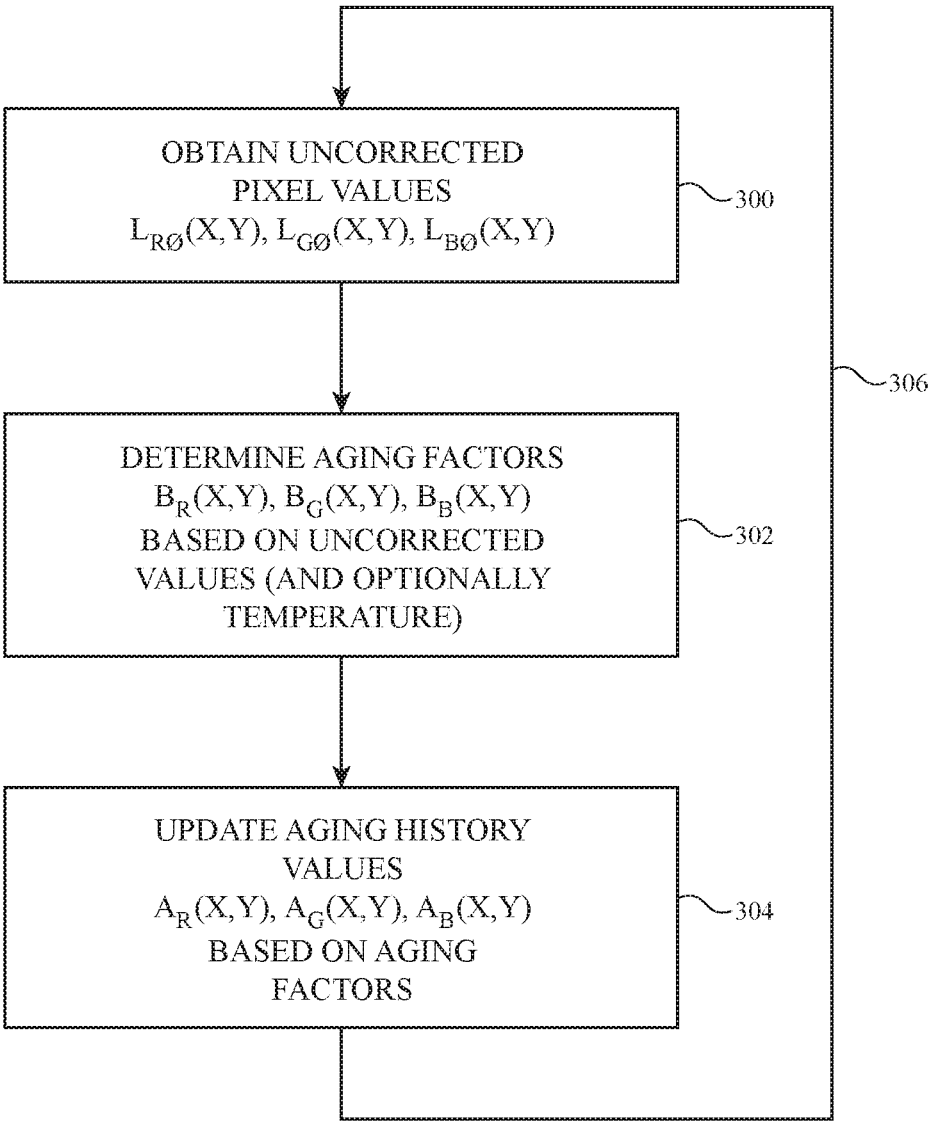
FIG. 4 is a flow chart of illustrative steps involved in maintaining pixel aging history information in an electronic device with a display in accordance with an embodiment.

FIG. 4 is a flow chart of illustrative steps involved in maintaining aging history information for display 14. At step 300, luminance degradation compensator 202 may obtain uncorrected pixel luminance values for the content generated by content generator 200. For example, compensator 202 may obtain the pixel luminance value for each pixel in a frame of image data to be displayed on display 14. The luminance values may include an uncorrected red pixel luminance value $L_{R0}(x,y)$ for each red pixel, an uncorrected green pixel luminance value $L_{G0}(x,y)$ for each green pixel, and an uncorrected blue pixel luminance value $L_{B0}(x,y)$ for each blue pixel. There may be any suitable number of luminance values associated with each pixel (e.g., 0-255, etc.).

Pixels at one luminance level (e.g., 0-10 nits) may age differently than pixels at another luminance level (e.g., 390-400 nits). Moreover, the amount of aging that each pixel experiences will generally be nonlinear as a function of luminance level (and temperature). For example, a pixel may degrade more if illuminated at 400 nits for one hour than if driven at 100 nits for four hours. To take account of these nonlinear aging effects, the aging behavior of the pixels may be ascertained during display testing and characterization and stored in the memory of control circuitry 16 (see, e.g., stored information 204). The aging behavior of the pixels may then be used in computing a value (sometimes referred to as an aging factor) for each pixel that represents how much a given pixel is being aged during a given display operation (e.g., when outputting light at a given luminance in an image frame). As shown in FIG. 4, aging factors B may be computed at step 302 based on the pixel luminance values in an image frame and, if desired, operating temperature. A separate aging factor B may be computed for each pixel in display 14 or aging factors may be computed and stored for blocks of pixels (e.g., 2×2 blocks or blocks of other sizes and shapes) to conserve memory. In scenarios in which compensator 202 computes an aging factor for each pixel in the frame of image data obtained at step 300, a frame-sized matrix of aging factors may be computed at step 302.

Aging factors B may be computed for each different color of pixel in display 14. For example, at 10 nits of illumination, red, green, and blue pixels in display 14 may each have a different corresponding value of aging factor B to take into account the varying behavior of each different pixel color during operation. At 20 nits of illumination, these factors may also be different and may change in a non-linear fashion. For example, the aging factor for blue pixels at 20 nits may be more than twice the aging factor for blue pixels at 10 nits and blue pixels may age more rapidly as a function of increasing luminance levels than red pixels (as an example). If desired, temperature information (e.g., a current measured temperature value from sensor 140) may be used in computing aging factors B.

The matrix of aging factors for red, green, and blue pixels that is produced at step 302 (i.e., red pixel aging factors $B_R(x,y)$, green pixel aging factors $B_G(x,y)$, and blue pixel aging factor $B_B(x,y)$) may be maintained as part of information 204 by compensator 202. To ensure that a complete (lifetime) history of aging effects for display 14 is maintained, the aging factors for the current frame that have been computed at step 302 may be used in updating a cumulative history matrix of aging history values A (i.e., a running history) at step 304. Aging history information for display 14 such as aging history values A(x,y) may include red pixel aging history values $A_R(x,y)$, green pixel aging history values $A_G(x,y)$, and blue pixel aging history values $A_B(x,y)$. As with the aging factors B, aging history information may be stored in a matrix that is equal in size to the image frame (e.g., a matrix with an aging history for each pixel in display 14) or may be stored in a reduced-size matrix (e.g., a matrix in which 2×2 blocks of adjacent pixels share a common aging history value) to conserve memory.

After the current aging factors B have been used to update the aging history A for the pixels in display 14, processing may loop back to step 300, as indicated by line 306. A new set of uncorrected pixel values may be obtained and processed in this way at a frequency of f1. Frequency f1 may be, for example, 60 Hz (e.g., frequency f1 may correspond to the frame rate at which display 14 displays frames of image data). Other frequencies f1 may be used when performing the operations of FIG. 4, if desired (e.g., f1 may be 0.005 Hz to 60 Hz, etc.).

Figure 5:
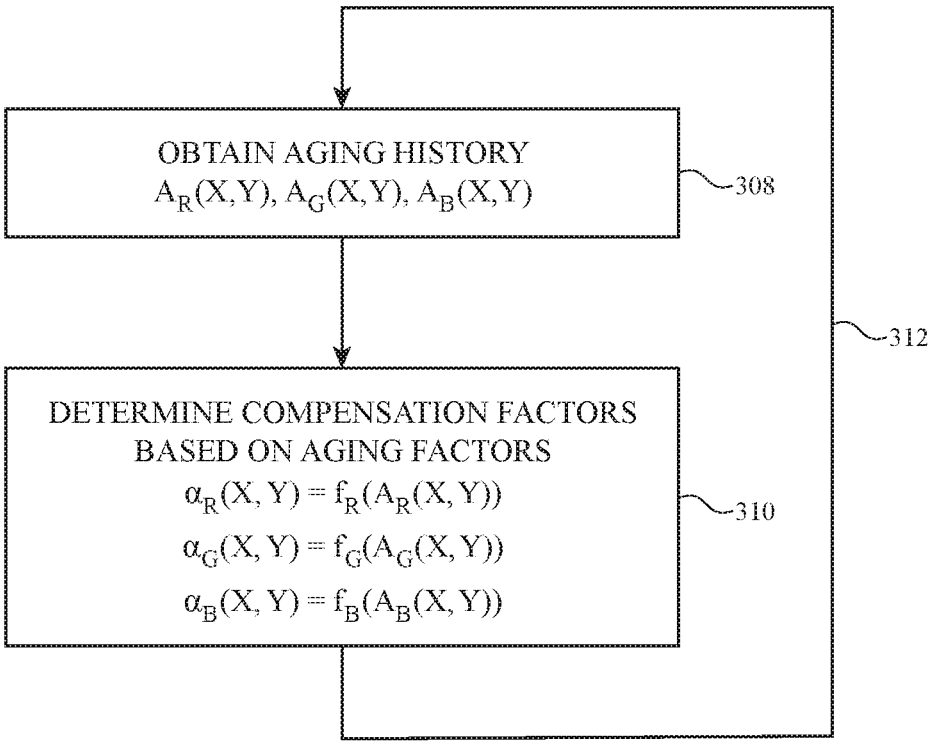
FIG. 5 is a flow chart of illustrative steps involved in updating a set of pixel aging compensation factors in an electronic device with a display in accordance with an embodiment.

The process of FIG. 4 may run continuously while image data is being displayed on display 14. In parallel, compensator 202 may maintain a set of pixel luminance compensation factors to apply to the uncorrected pixel values. FIG. 5 is a flow chart of illustrative operations involved in using current aging history information to update a set of pixel compensation values. At step 308, compensator 202 may obtain a current set of aging history values (entries A from the aging history matrix that is updated during the operations of step 304 in FIG. 4). These aging history values represent how much each pixel in display 14 has aged and has therefore degraded.

At step 310, pixel luminance degradation compensation factors $\alpha_R$, $\alpha_G$, and $\alpha_B$ may be determined for each of the red, green, and blue pixels of display 14, respectively. For example, at each value of x and y, a compensation factor for the red pixel at that location may be computed using age-induced-luminance-degradation estimation function $f_R$ (i.e., $\alpha_R=f_R(A_R(x,y))$). Compensation factors $\alpha_G$ (for the green pixels) and $\alpha_B$ (for the blue pixels) may be computed using corresponding age-induced-luminance-degradation estimation functions $f_G$ and $f_B$. Functions $f_R$, $f_G$, and $f_B$ may be obtained during manufacturing and testing operations when characterizing display 14 and may be maintained as part of information 204. Compensation factor information (i.e., the computed values of $\alpha$) may be stored in a matrix that is equal in size to a display image frame (e.g., a matrix with an compensation factor value for each pixel in display 14) or may be stored in a reduced-size matrix (e.g., a matrix in which 2×2 blocks of pixels or blocks of other numbers of pixels share a common compensation history value) to conserve memory.

As indicated by line 312, the process of FIG. 5 may be performed continually. The loop of FIG. 5 may be performed at a frequency f2. This frequency may, as an example, be lower than the frequency f1 of the loop of FIG. 4 (as an example). With one illustrative configuration, frequency f2 may be about 0.002 Hz to $10^{-6}$ Hz (as an example).

Figure 6:
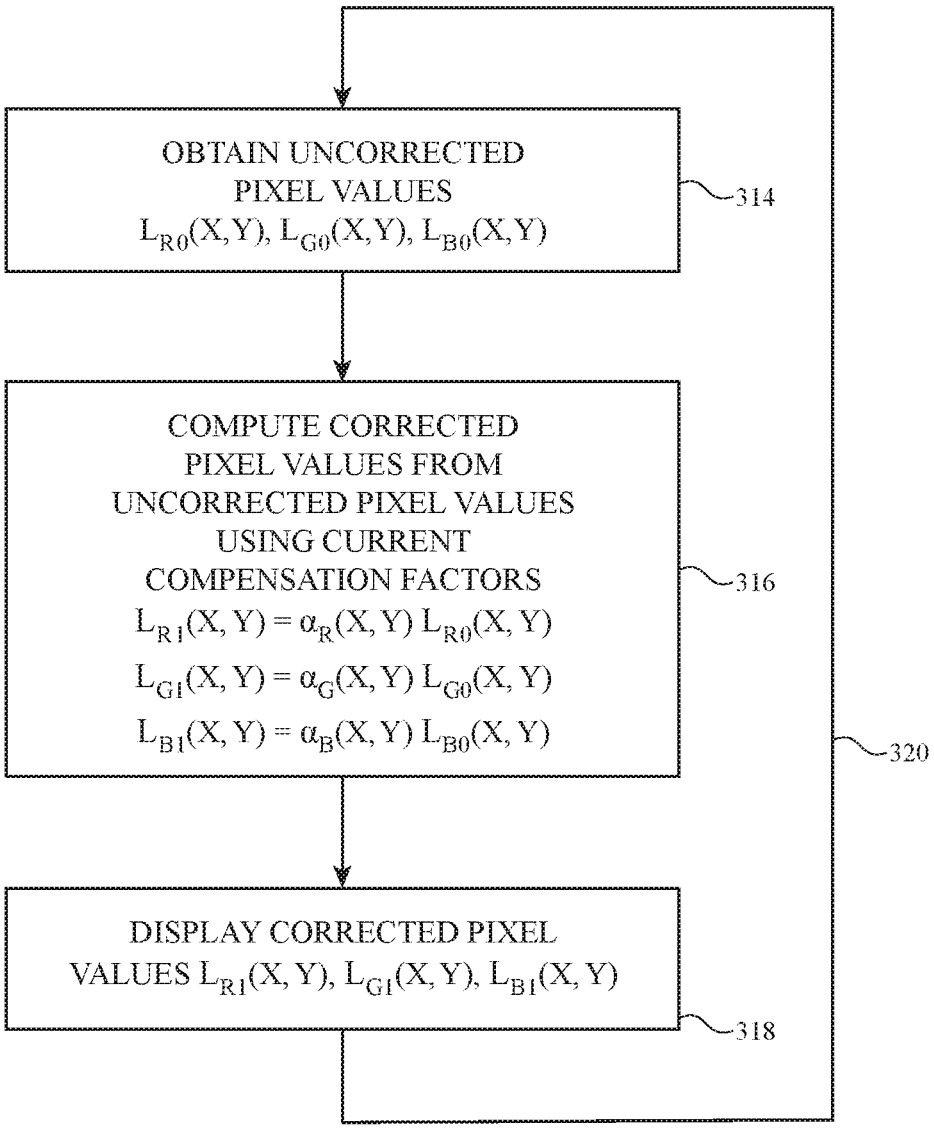
FIG. 6 is a flow chart of illustrative steps involved in displaying content on a display using corrected pixel values in accordance with an embodiment.

The aging history maintenance operations of FIG. 4 and the compensation factor updating operations of FIG. 5 may be performed at the same time that compensated content from content generator 200 is being displayed on display 14 by compensator 202 on control circuitry 16. Illustrative operations involved in compensating the uncorrected pixel values from content generator 200 with the compensation factors determined during the operations of FIG. 5 are shown in FIG. 6.

At step 314, compensator 202 may obtain uncorrected pixel values for a frame of image data from content generator 200.

At step 316, compensator 202 may compute corrected pixel luminance values for each pixel in the frame of image data. The corrected pixel values $L_{R1}$, $L_{G1}$, and $L_{B1}$ for red, green, and blue pixels, respectively, may be computed by applying the compensation factors $\alpha_R$, $\alpha_G$, and $\alpha_B$ that were computed during step 310 of FIG. 5. In particular, $L_{R1}=\alpha_G(x,y)\ L_{R0}(x,y)$, $L_{G1}=\alpha_G(x,y)\ L_{G0}(x,y)$, and $L_{B1}=\alpha_B(x,y)\ L_{B0}(x,y)$ for each of the pixel in display 14. Compensation factors $\alpha$ are used to increase the luminance values of pixels that have degraded emissive material or other age-induced damage that causes those pixels to emit less light for a given luminance value setting (i.e., drive current) than they were originally capable of emitting. The values of $\alpha$ will therefore be 1.0 for pixels that are operating with their original efficiency and will be more than 1.0 for pixels that have degraded.

At step 318, control circuitry 16 (e.g., compensator 202) may use display 14 to display an image frame containing the compensated (corrected) pixel luminance values of step 316.

As indicated by line 320, the process of FIG. 6 may be performed continuously (e.g., at frequency f3 equal to the frame rate with which compensator supplies corrected images frames to display 14).

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a display having an array of pixels, each pixel having a respective light-emitting device, wherein the light-emitting devices comprise light-emitting diodes, and wherein the light-emitting diodes comprise crystalline semiconductor dies;

control circuitry that displays content on the array of pixels of the display; and a pixel luminance degradation compensator implemented on the control circuitry that adjusts uncorrected pixel luminance values for the pixels to compensate for aging-induced pixel luminance degradation in the light-emitting devices, wherein the pixel luminance degradation compensator is configured to update pixel aging history information for the array of pixels at a first frequency and to determine compensation factors for adjusting the pixel luminance values at a second frequency that is different than the first frequency, and wherein the pixel luminance degradation compensator is further configured to:

determine aging factors directly from the uncorrected pixel luminance values, wherein the aging factors represent how much one of the pixels of the array of pixels or a block of pixels of the array of pixels has aged during operation of the display;

update the pixel aging history information based on the aging factors; and determine compensation factors based on the updated pixel aging history information using age-induced-luminance-degradation functions, wherein the pixel luminance degradation compensator adjusts the uncorrected pixel luminance values using the compensation factors to generate corrected pixel luminance values, wherein the corrected pixel luminance values are a product of the compensation factors and the uncorrected pixel luminance values.

2. The electronic device defined in claim 1 further comprising a temperature sensor that provides temperature measurements to the pixel luminance degradation compensator, wherein the pixel luminance degradation compensator determines the aging factors based at least partly on the temperature measurements.

3. An electronic device, comprising:

a display having an array of pixels, wherein each of the pixels has a respective light-emitting diode; and control circuitry on which a content generator and a pixel luminance degradation compensator are implemented, wherein the pixel luminance degradation compensator is coupled between the content generator and the array of pixels, wherein the content generator produces image content for the display with uncorrected pixel luminance values, and wherein the pixel luminance degradation compensator is configured to:

determine aging factors based on the uncorrected pixel luminance values, wherein the aging factors represent how much one of the pixels of the array of pixels or a block of pixels of the array of pixels has aged during operation of the display;

update aging history values based on the aging factors;

calculate compensation factors using nonlinear aged-induced-luminance-degradation functions based on the updated aging history values; and compute corrected pixel luminance values from the uncorrected pixel luminance values and the compensation factors, wherein the corrected pixel luminance values are a product of the uncorrected pixel luminance values and the compensation factors, wherein the control circuitry includes protected storage that is not disturbed when installing operating system code on the electronic device, and wherein the aging history values are maintained in the protected storage.

4. The electronic device defined in claim 3 wherein the light-emitting diodes comprise organic light-emitting diodes.

5. The electronic device defined in claim 3 wherein the light-emitting diodes comprise quantum dot light-emitting diodes.

6. The electronic device defined in claim 3 wherein the light-emitting diodes comprise discrete crystalline semiconductor dies.

7. The electronic device defined in claim 3 further comprising a temperature sensor that gathers temperature measurements, wherein the pixel luminance degradation compensator produces the compensation factors at least partly based on the temperature measurements.

8. An electronic device, comprising:

an organic light-emitting diode display having an array of pixels, wherein the array of pixels comprises a plurality of discrete crystalline semiconductor dies; and control circuitry on which a content generator and a pixel luminance degradation compensator are implemented, wherein the content generator produces image content for the display with uncorrected pixel luminance values, and wherein the pixel luminance degradation compensator:

determines aging factors based on the uncorrected pixel luminance values, wherein the aging factors are non-linearly dependent on the uncorrected pixel luminance values and wherein the aging factors represent how much one of the pixels of the array of pixels or a block of pixels of the array of pixels has aged during operation of the organic light-emitting diode display;

updates pixel aging history information based on the aging factors;

determines compensation factors based on the updated pixel aging history information using nonlinear age-induced-luminance-degradation functions; and computes corrected pixel luminance values by multiplying the compensation factors with the uncorrected pixel luminance values, wherein the control circuitry comprises protected storage that is not disturbed when installing operating system code on the electronic device, and wherein the pixel aging history information is maintained in the protected storage.

9. The electronic device defined in claim 8 further comprising a temperature sensor that gathers temperature measurements, wherein the pixel luminance degradation compensator maintains the pixel aging history information in the control circuitry based at least partly on the temperature measurements.

* * * * *